United States Patent [19]

Camiciotti et al.

[11] Patent Number: 4,709,563

[45] Date of Patent: Dec. 1, 1987

[54] NEEDLE-SELECTING SYSTEM FOR CIRCULAR KNITTING MACHINE

[75] Inventors: Leonardo Camiciotti; Edoardo Furia, both of Florence, Italy

[73] Assignee: Novitex s.r.l., Florence, Italy

[21] Appl. No.: 828,968

[22] Filed: Feb. 12, 1986

[30] Foreign Application Priority Data

Feb. 15, 1985 [IT] Italy ..... 9336 A/85

[51] Int. Cl.[4] ..... D04B 9/36; D04B 15/68

[52] U.S. Cl. ..... 66/222; 66/43

[58] Field of Search ..... 66/30, 37, 39, 43, 46, 66/51, 222

[56] References Cited

U.S. PATENT DOCUMENTS 2,952,147 9/1960 Ziemba ..... 66/43

FOREIGN PATENT DOCUMENTS 2448282 4/1975 Fed. Rep. of Germany ..... 66/43

*Primary Examiner*—Wm. Carter Reynolds

*Attorney, Agent, or Firm*—Hopgood, Calimafde, Kalil, Blaustein & Judlowe

[57] ABSTRACT

In order to form argyle intarsia patterns, stacked arrays of selection levers cooperate with selection butts, the levers being capable of selecting the needles to be raised. Each array of selection levers is located symmetrically between two adjacent yarn feeding stations for cooperation with one or the other feeding station to select the desired needles depending upon the direction of machine reciprocating motion. The jack lifting and lowering profiles on the respective operative cam rings are symmetrical with respect to the feeding stations and to the arrays of selection levers. The jack lifting profiles include "V" shaped notches in alignment with the selection levers, and, correspondingly, the intermediate-jack lowering profiles include "V" shaped projections provided for further lowering the intermediate jacks.

1 Claim, 3 Drawing Figures

NEEDLE-SELECTING SYSTEM FOR CIRCULAR KNITTING MACHINE

BACKGROUND OF THE INVENTION

In a circular knitting machine for the production of socks or knitted articles with argyle intarsia pattern obtained by a reciprocating motion - like the machine described in Italian Pat. No. 997,212 —it is necessary to select - before every yarn-feeding station and in both directions of motion - those needles which are going to knit with the yarn fed at that particular station. This selection is mechanically achieved by means of peg drums which act upon the butts of the selection jacks according to certain programmable sequences; this action is performed by dual fork-like selection levers superimposed to form a pack.

As it is known, the patterns obtainable by this method have, in the width direction, a maximum number of needles equal to the number of butts of the selection jacks which can be arranged diagonally (or, in the case of a symmetrical pattern, which can be arranged according to a double "V"-shaped diagonal) and have, in the length direction, a maximum number of courses equal to the number of rows of pegs available on the circumference of each pattern drum.

These limits in the possible patterns achievable could be overcome by adopting electronic programmers.

Nevertheless, direct control on this type of selection fork levers by means of electromagnetic actuators cannot be easily carried out either because of the necessary, considerable forces and high response speeds (which cannot be attained owing to the limited space available) or because the diagonal of the selecting butts should be wider than the levers themselves, in order to allow their up and down movement in the empty space between one diagonal and the other. It would be necessary, therefore, to increase the number of butts, make the cylinder higher and adopt other expedients with all the ensuring drawbacks.

It is possible to divide each pack of double levers into two packs of single levers, but this requires a number of packs of levers (and thus of electromagnetic actuators) twice as much as the number of feeds, with consequent big problems as for the space available around the cylinder and higher cost.

SUMMARY OF THE INVENTION

It is an object of this invention to provide a machine and a method to select the needles during both motion directions, substantially by providing packs, that is, rows of single selection levers, the latter being sufficiently light and thin to act between one butt and the other of the same row, that is, of the same level and belonging to adjacent groups of selection jacks in which, for example, the butts are diagonally arranged, said selection levers being symmetrically disposed in respect to particular cam profiles of a selection ring so as to require only a number of actuator packs equal to that of the feeds, said packs being possibly controlled by mechanical, electronic or whatever other type of means.

In other words, a machine according to the invention —for the formation of articles having argyle intarsia pattern, with a driving of the needles cylinder at reciprocating motion, having needles, intermediate jacks and selection jacks provided with selection butts, and packs of selection cams or levers, said cams or levers being able to select the needles to be raised - where the same group, that is, a pack of selection levers is located between two adjacent feeds and selects the needles for one or the other feed in one or the other direction of the machine reciprocating motion.

In practice, the selection levers usually operate with a thrust on selection jacks associated with elastic pusher jacks, with which a selection ring with rising profiles cooperates, while the oppposite profiles of a lowering-cam ring cooperate with the intermediate jack butts. In this case it is possible to provide: that said rising profiles are symmetrical with respect to the feeding stations and to the packs of selection levers and that the profiles of the control ring for lowering the intermediate jacks are symmetrical in a similar way; that said rising profiles have, in correspondence with the selection levers, "V"-shaped notches having the bottom slightly lower than the path of the butts of the lowered elastic jacks, while corresponding lower projections are provided in the control ring for the lowering of the intermediate jacks. The width of the notches is smaller than the width of the selection levers, so let the butt of the elastic pusher jacks enter into the V-shaped notch and be raised by the cam rising profiles whenever the pattern selector jack is not pressed by the selecting lever, thus obtaining the selective raising of the needle. The selection jacks are subdivided into groups, in each of which a butt is present on each of the butt rows, in correspondence with which rows the selection levers are located; the distance between two adjacent butts along a same row will be sufficient to permit the control of the selection lever within the time interposed between the passage of one butt and the following in front of it.

The invention is suitable for converting existing machines. In the existing raising ring cam, V-shaped notches are formed. In the existing ring cam for the lowering of the intermediate jacks, projections are added corresponding to said notches for lowering the intermediate jacks to a lower level than the needles, and for lowering the butts of the elastic jacks to the level of the V notches; selection levers are provided at the positions defined by said V notches and said projections, said levers being just a little wider than said V notches. An initial overtravel of the intermediate jack, pushed by the elastic pusher jack is provided by the butt of the latter acting on the sides of said V notches prior to the beginning of the needle rising.

BRIEF DESCRIPTION OF THE DRAWINGS

The following description and the attached drawing illustrate a practical non limitative exemplification of an embodiment of the invention. In the drawing.

DESCRIPTION OF THE PREFERRED EMBODIMENT

Figure 1:
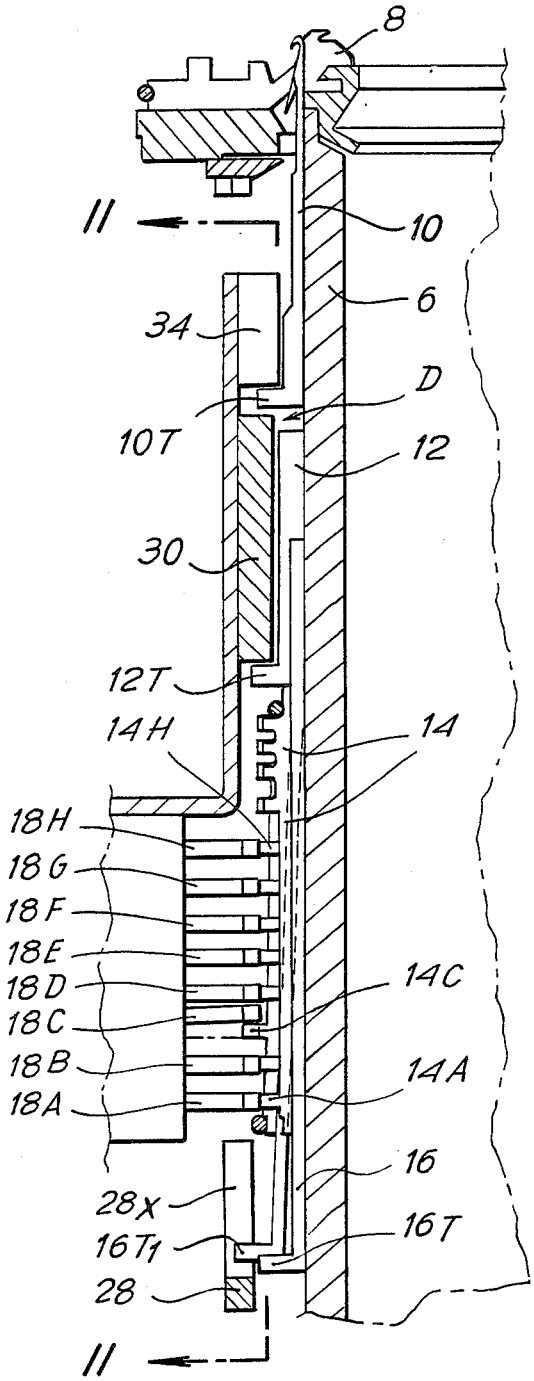
FIG. 1 shows a rough partial section view on an axial plane, of the needles cylinder, approximately taken on line I—I of FIG. 2.
Figure 2:
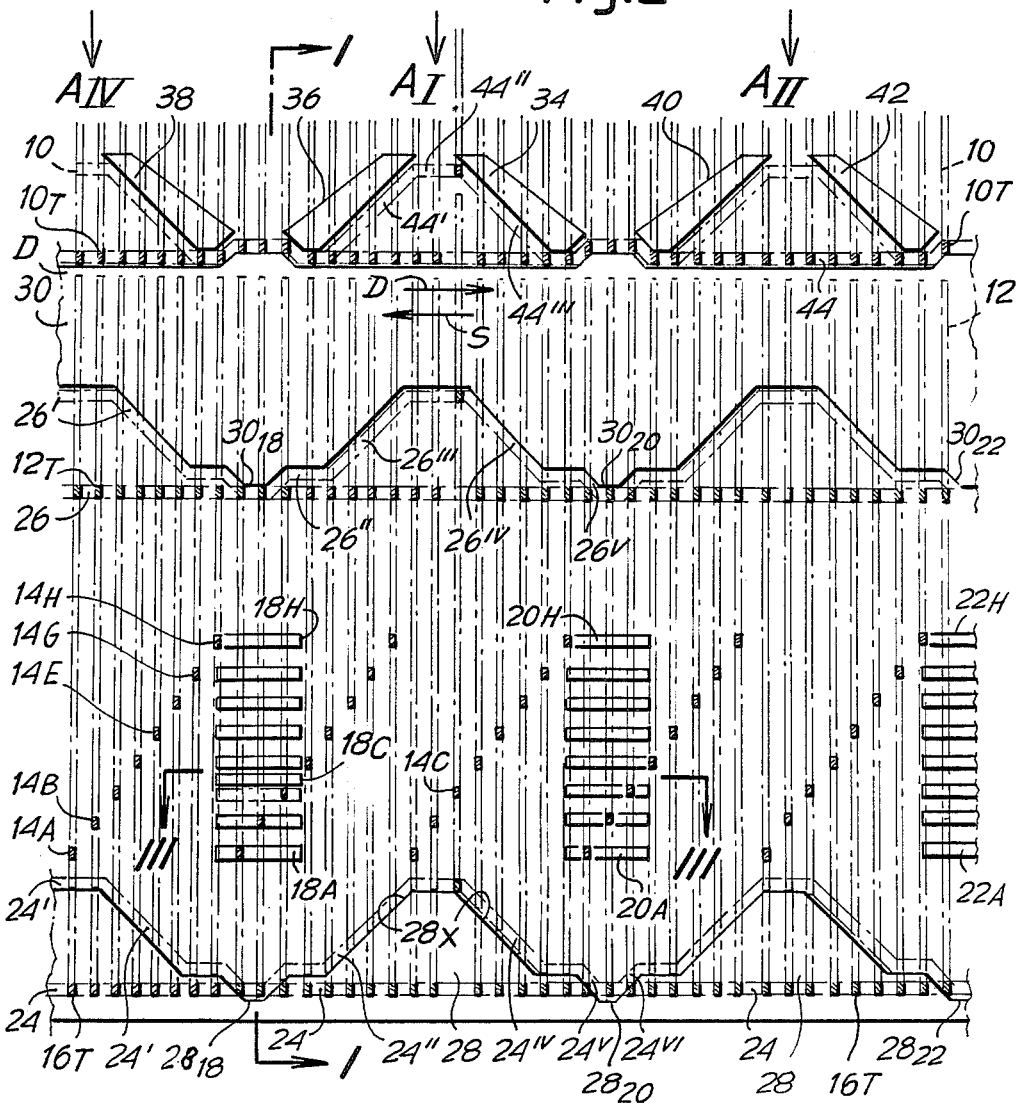
FIG. 2 is a rough view through line II—II of FIG. 1.

In the drawing, numeral 6 indicates the cylinder, 8 indicates the sinkers radially slideable placed on the end of the cylinder, 10 indicates the needles provided with butts 10T and sliding within the channels of the cylinder; numeral 12 indicates the intermediate jacks, housed inside the channels of the cylinder and provided with butts 12T; numeral 14 indicates the oscillating selection jacks each one having a butt 14A . . . 14H disposed on each of the eight different horizontal levels, the jacks 14 being in groups of eight; the selection jacks 14, which are free to oscillate but do not move vertically, are associated with corresponding spring pusher-jacks 16 with butts 16T representing a typical selection system being known and applicable to the embodiment of the invention as illustrated. AI, AII, AIV indicate the yarn feeding positions. On the left of the feed AI (see the drawing FIG. 2) between said feed AI and feed AIV, a pile or pack of selection levers 18A . . . 18H is located, each selecting lever being disposed on the corresponding level on which the butts 14A . . . 14H of the jacks 14 of each group are located; these selection levers are movable specifically in vertical direction—in order to act or not to act upon respective butts 14A . . . 14H. In a symmetrical position relative to the feed AI another pile or pack of selection levers 20A . . . 20H is located between feed AI and feed AII. The pile or pack of selection levers 20 is, in respect to the feed AII, in a position similar to the one in which the selection levers 18A . . . 18H are in respect to the feed AI; similarly, the pile or pack of selection levers 18A . . . 18H is, in respect to the feed AIV, at an analogous position to that in which the selection levers 20A . . . 20H are in respect to the feed AI. In other words, the pile or pack of selection levers 18A . . . 18H is at an intermediate position between the feed AIV and AI, the pile or pack of selection levers 20A . . . 20H is intermediate between the feed AI and AII, and so on. The selection levers 18A . . . 18H, 20A . . . 20H, etc., are electronically controlled via per se known electromagnets. When a selection lever, like that indicated by 18C, has been lifted (see FIG. 1), the corresponding butt 14C is not depressed thus letting the corresponding butt 16T, engage with its corresponding lifting cam. Whan a selection lever 18 is kept lowered, it pushes the respective butt 14 towards the cylinder 6 in order to selectively act upon the respective elastic pusher-jack 16 which is thus kept pressed inside the channel. The respective butt 16T is therefore retracted towards the cylinder, missing the rising profile and remaining at the inactive level 24. Numeral 26 indicates the corresponding inactive path of butts 12T. Numeral 28 indicates the cam ring with its raising and selecting profiles acting on the butts 16T of the pushing jacks 16. The active lifting ramps 28X are symmetrical with respect to the position of the piles or packs of selection levers 18A . . . 18H, 20A . . . 20H, etc., and with respect to the feeding stations. The lifting cam profiles of the ring 28 are joined in correspondence with each pile or pack of selection levers 18A . . . 18H, 20A . . . 20H, etc., by the corresponding V notches profiles indicated by $28_{18}$, $28_{20}$, $28_{22}$, etc. with the bottom level slightly lower than path 24.

Numeral 30 indicates the ring which forms, with its lower part, control profiles for lowering the intermediate jacks 12, acting on butts 12T. The lay-out of the profiles is similar—but opposite—to that of the ring 28. Particularly, lower projections $30_{18}$, $30_{20}$, $30_{22}$, etc., of said profiles are provided in correspondence with V notches $28_{18}$, $28_{20}$, $28_{22}$, etc., and in correspondence with the selection levers 18A . . . 18H, 20A . . . 20H, etc.; said projections $30_{18}$, $30_{20}$, $30_{22}$ are capable of lowering the butts 12T as low as the level of path 26.

Numeral 34, 36 indicate the two symmetrical knitting cams, for lowering butts 10T of the needles raised by the intermediate jacks which, in turn, have been lifted by the pusher jacks engaged with one of the two ramps 28X, depending upon the motion direction. Numeral 38 shows one of the knitting cams of the feed AIV, and numerals 40 and 42 indicate the knitting cams of the feed AII.

Each feed has, therefore, all the details as described for the feed AI. The working of the individual members is well known to those skilled in the art.

The machine according to the present invention operates as follows:

Assuming that the needles cylinder 6 moves in the direction of arrow D and all the selection levers of the pile or pack 18A . . . 18H are positioned to press all the respective butts 14A, 14B . . . 14H of selectors 14. The butts 16T—either coming from the path 24' imposed by the profile of cam 30, or from the inactive path 24—are all pressed against the cylinder and carried to the lower level alongside the notch $28_{18}$, by the protruding profile $30_{18}$ and, therefore, they overlie the hollow of the notched profile $28_{18}$, without being engaged by the profile of the ramp 28X, and remain in the inactive path 24. The respective intermediate jacks coming alternatively from the path 26' or from the path 26 and lowered by the profile $30_{18}$ will follow the inactive path 26. As a consequence, no needle will make any stitch upon this phase and its butt 10T will remain on the inactive path 44.

Assuming now that one of the selection levers, for example the one indicated as 18C (see FIG. 1) corresponding to the butt 14C of a selection jack 14, has been raised. The selection jack 14 having the butt 14C will not be pressed when alongside the profile $28_{18}$. The butt 16T of the relevant pusher jack 16, urged outward by the elastic force toward the position $16T_1$, will enter the V notched profile $28_{18}$, engage the cam profile and be raised following the path 24" on the raising or lifting ramp 28X. After an initial lifting travel of the jack 16, which compensates for the gap D (See FIG. 1) created by the overtravel of the intermediate jack obtained by projection $30_{18}$, the said intermediate jack 12 will be raised by the above mentioned pusher 16 and will follow the path 26" and 26''' thereby lifting, in turn, the relevant needle 10; said needle, by moving onto the path 44', will reach the clearing level 44", will take the new yarn from the feeding station AI along said path 44" and will knot a new stitch while being lowered by the knitting cam 34 down on path 44''' to go back again with its butt 10T on path 44. At the same time, the intermediate jack 12, pushed downwardly by the profile of cam 30, will follow the path $26^{IV}$, $26^{V}$, lowering, in turn, the pusher 16 along the path $24^{IV}$ and $24^{V}$ toward the level close to the bottom of the notch $28_{20}$ where by means of the pack or pile of levers 20A . . . 20H a new selection of needles will take place, to select whichever needle has to knit at the next feeding station AIII. The selection levers 20A . . . 20H (or others) which are in a push position, force the respective butts 16T to pass behind the ring 28 following the inactive path 24.

During the reversal of motion in the S direction—reference being made for simplicity's sake to the same figure and designations—the pushers corresponding to those pusher jacks 16 being pressed against the cylinder by the respective selection levers of pack 20A . . . 20H will follow the path $24^{VI}$, or 24, while the butts 16T of those pusher jacks 16 being released by the respective selection levers 20A . . . 20H, will enter the V notch $28_{20}$, will engage the cam profile and rise following the path $24^{V}$ and $24^{IV}$, pushing up, in turn, the respective intermediate jack 12 from the inactive path 26 up to the path $26^{V}$, $26^{IV}$. In this way, the corresponding needles 10 will rise following the path 44''' up to the plateau level 44'' to take the yarn from the feeding station AI and knit the stitch being pushed by the knitting cam 36 along the path 44'.

The operation is cyclically repeated in the two directions and for all the present or active feeding stations.

Figure 3:
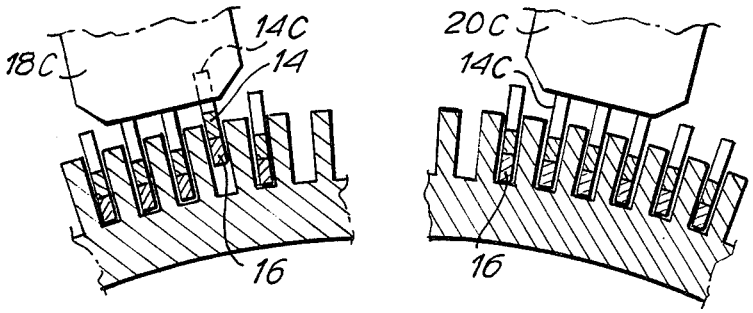
FIG. 3 is a rough section view on line III—III of FIG. 2.

The action of the selection levers of pressing the elastic pusher jacks 16 towards the cylinder to prevent the butt 16 from engaging the lifting profile of the ring 28 is to be exerted over the width of the notch profiles, e.g., like those indicated by $28_{18}$, $28_{20}$, $28_{22}$, etc., therefore said selection levers 18A . . . 18H, 20A . . . 20H, etc., must be correspondingly developed horizontally, as shown in FIG. 3, and are suitably bevelled. The control—for example electromagnetic with return spring—of the selection levers may be operated during the interval between the transit of two successive selection butts 14A . . . 14H from successive groups of selection jacks 14, which, for example, are in number of eight for each group of the illustrated disposition in the drawing. The butts 14A . . . 14H may have, for example, a diagonal or other suitable arrangement. Each selection lever 18 may be controlled a little in advance, before its relevant butt of the pusher jack 16 reaches the notch $28_{18}$ or $28_{20}$ or $28_{22}$, etc.; in fact, the butt 16T slides inside and against the ring 28 and snaps elastically into the notch upon reaching same (to be engaged by the rising ramp 28X) unless it is pressed by the relevant selection lever. All this can be achieved through an electronic and electromagnetic selection in the realization of the invention, or through conventional mechanical systems.

The invention is also—and advantageously—able to be applied to existing and conventional argyle intarsia pattern knitting machines, converted with the use of modern types of actuators (especially electronic) and packs of selection levers like those indicated by 18, 20, 22 etc. In practice, the conversion consists in replacing the controls and the selection levers—which are of limited dimensions—modifying the cam ring 28 with notches $28_{18}$, $28_{20}$, $28_{22}$ etc., and the cam ring 30 with projections $30_{18}$, $30_{20}$, $30_{22}$ etc.

The drawing shows only one exemplification of the invention, but the embodiments of the invention may vary in the form and dispositions though remaining within the scope of the claims.

We claim:

1. A circular knitting machine for the production of articles having an argyle or mosaic pattern, comprising a needle cylinder mounted for reciprocatory rotary motion and having latch needles, intermediate jacks and selection jacks provided with selection butts with which stacked arrays of selection levers cooperate, the latter being disposed to select the needles to be raised to knit by depressing said selection jacks, the latter being associated with elastic pusher jacks having respective butts; a bottom cam ring having lifting profiles arranged to cooperate with said pusher jacks; and a top cam ring having profiles arranged to cooperate with said intermediate jacks; wherein a stacked array of selection levers is disposed centered circumferentially between adjacent yarn feeding stations for selecting the needles to clear and knit in one or the other of said adjacent feeding stations depending upon the direction of said reciprocatory motion, said lifting profiles of said bottom cam ring being substantially symmetrically located with respect to said feeding stations and to said stacked arrays of selection levers, said profiles of said top cam ring being similarly symmetrically located for controlling and lowering said intermediate jacks, said profiles of said bottom cam ring having, in alignment with said selection levers, V-notched profiles with a bottom slightly lower than the lower dwell path of said butts of said elastic pusher jacks, while corresponding lower projections are provided on said top cam ring for the control and lowering of said intermediate jacks; the width of said V-notched profiles being less than that of said selection levers to obtain by elasticity the engagement and subsequent lifting of said butts of said pusher jacks on said lifting profiles, whenever one selection lever does not depress the relative corresponding butt of the selection jack, and the butt of said elastic pusher jack enters said V-notched profile and engages said lifting profile, in order to obtain said selection of said needles.

* * * * *